US011420166B2

(12) United States Patent
Eiche et al.

(10) Patent No.: US 11,420,166 B2
(45) Date of Patent: Aug. 23, 2022

(54) AGITATOR DEVICE AND METHOD

(71) Applicant: EKATO Ruehr- und Mischtechnik GmbH, Schopfheim (DE)

(72) Inventors: Sammy Eiche, Rheinfelden (DE); Jochen Jung, Loerrach (DE); Florian Kikillus, Wehr (DE); Nicole Rohn, Rheinfelden (DE); Bernd Kastner, Steinen (DE)

(73) Assignee: EKATO Rühr- und Mischtechnik GmbH, Schopfheim (DE)

( * ) Notice: Subject to any disclaimer, the term of this patent is extended or adjusted under 35 U.S.C. 154(b) by 487 days.

(21) Appl. No.: 16/324,405

(22) PCT Filed: Aug. 11, 2017

(86) PCT No.: PCT/EP2017/070404
§ 371 (c)(1),
(2) Date: Feb. 8, 2019

(87) PCT Pub. No.: WO2018/029332
PCT Pub. Date: Feb. 15, 2018

(65) Prior Publication Data

US 2019/0176105 A1 Jun. 13, 2019

(30) Foreign Application Priority Data

Aug. 12, 2016 (DE) ..... 10 2016 115 046.0

(51) Int. Cl.
*B22C 5/00* (2006.01)
*B01F 27/07* (2022.01)
(Continued)

(52) U.S. Cl.
CPC ..... *B01F 27/071* (2022.01); *B01F 27/0726* (2022.01); *B01F 27/113* (2022.01); *B01F 35/10* (2022.01)

(58) Field of Classification Search
CPC ..... B01F 7/001
See application file for complete search history.

(56) References Cited

U.S. PATENT DOCUMENTS 1,506,937 A 9/1924 Miller
1,898,628 A 2/1933 Hollerith
(Continued)

FOREIGN PATENT DOCUMENTS

CH 690835 A5 * 2/2001 ..... C05F 3/06
CH 690835 A5 2/2001
(Continued)

OTHER PUBLICATIONS

Google machine translation of CH690835A5 (Year: 2001).*
(Continued)

*Primary Examiner* — Anshu Bhatia
*Assistant Examiner* — Gregory Y Huan
(74) *Attorney, Agent, or Firm* — Posz Law Group, PLC

(57) ABSTRACT

An agitator device is provided having at least one carrier unit, which has at least one connection element for a connection to a drive shaft and at least one beam element for the fastening of at least one agitator blade. The beam element and the connection element may be connected to one another in a one-part implementation.

19 Claims, 8 Drawing Sheets

Figure 1:
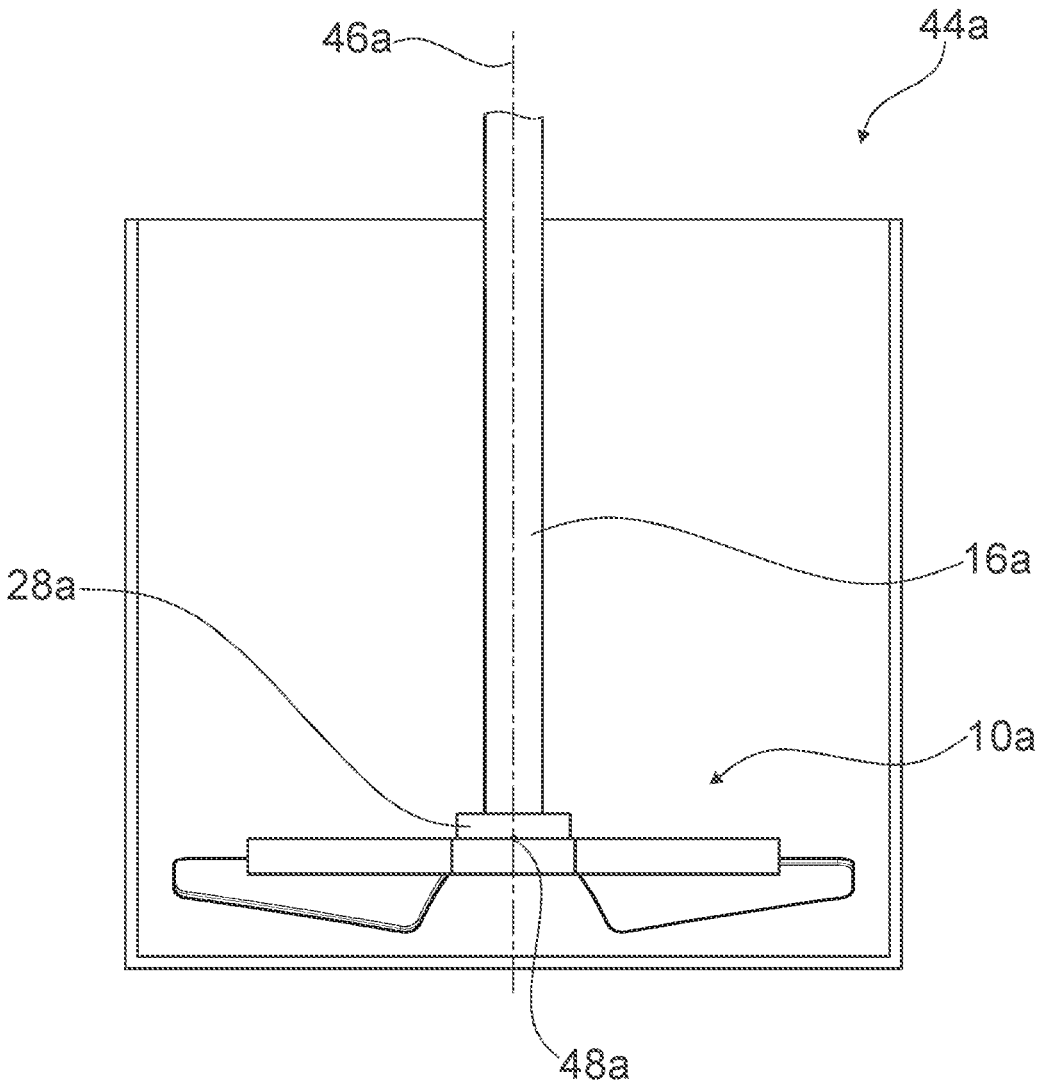

(51) Int. Cl.

| | |
|---|---|
| ***B01F 27/113*** | (2022.01) |
| ***B01F 27/072*** | (2022.01) |
| ***B01F 35/10*** | (2022.01) |

(56) References Cited

U.S. PATENT DOCUMENTS

| | | | | |
|---|---|---|---|---|
| 3,090,606 | A | 5/1963 | Burnet | |
| 4,054,272 | A | 10/1977 | Cooke | |
| 4,721,394 | A * | 1/1988 | Casto | B01F 7/00341 366/330.2 |
| 5,246,343 | A | 9/1993 | Windsor et al. | |
| 5,595,475 | A | 1/1997 | Weiss et al. | |
| 5,951,162 | A | 9/1999 | Weetman et al. | |
| 7,473,025 | B1 * | 1/2009 | Howk | B01F 27/113 29/889.7 |
| 8,579,588 | B1 | 11/2013 | Boyd | |
| 9,248,420 | B2 * | 2/2016 | Rawlings | B01F 7/06 |
| 2003/0035341 | A1 * | 2/2003 | Blakley | B01F 7/001 366/330.2 |
| 2006/0093957 | A1 | 5/2006 | Casalmir et al. | |
| 2008/0130406 | A1 | 6/2008 | Rosso et al. | |
| 2015/0044057 | A1 | 2/2015 | Dinnison | |

FOREIGN PATENT DOCUMENTS

| | | | | |
|---|---|---|---|---|
| DE | 4401596 | A1 * | 7/1995 | B01F 7/00341 |
| DE | 198 59 511 | A1 | 7/2000 | |
| DK | 2 364 770 | T3 | 1/2017 | |
| EP | 0 664 155 | A1 | 7/1995 | |
| EP | 2 364 770 | A1 | 9/2011 | |
| EP | 2364770 | A1 * | 9/2011 | B01F 7/0015 |
| EP | 2 364 770 | B1 | 10/2016 | |
| GB | 199708 | A | 8/1924 | |
| WO | 99/21647 | A1 | 5/1999 | |

OTHER PUBLICATIONS

Google machine translation of EP2364770A1 (Year: 2011).*
Google machine translation for "DE-4401596-A1" (Year: 1995).*
Office Action dated Apr. 13, 2017 issued in corresponding DE patent application No. 10 2016 115 046.04 (and English translation).
International Search Report dated Feb. 27, 2018 issued in corresponding International Application No. PCT/EP2017/070404.
International Preliminary Report on Patentability dated Feb. 12, 2019 issued in corresponding International Application No. PCT/EP2017/070404.
Office Action dated Feb. 24, 2021 issued in corresponding CN patent application No. 201780057103.3 (and English translation).
Office Action dated Apr. 24, 2021 issued in corresponding IN patent application No. 201917005128.
Office Action dated Sep. 21, 2021, issued in corresponding DE Patent Application No. 102016115046.0 (and English Machine Translation).
Office Action dated Sep. 18, 2021 issued in corresponding CN 201780057103.3 (English Translation Attached).
Office Action dated Feb. 9, 2022, issued in corresponding CN Patent Application No. 201780057103.3 (and English Machine Translation).

* cited by examiner

AGITATOR DEVICE AND METHOD

CROSS REFERENCE TO RELATED APPLICATIONS

This application is a U.S. national stage application of PCT/EP2017/070404 filed on Aug. 11, 2017, which is based on German Patent Application No. 10 2016 115 046.0 filed on Aug. 12, 2016, the contents of which are incorporated herein by reference.

PRIOR ART

The invention relates to an agitator device as per the preamble of claim 1.

Agitator bodies having a hub and having carrier struts welded to the hub, to which carrier strut in each case one agitator blade is fastened, are known from the prior art. Here, the hub is drive shaft of an agitator. Furthermore, agitating elements are known in the case of which agitator blades are welded directly to a hub.

It is the object of the invention in particular to provide a generic agitator device with improved characteristics with regard to a design. The object is achieved according to the invention by means of the features of patent claims 1, 2 and 15, whereas advantageous embodiments and refinements of the invention can be gathered from the subclaims.

Advantages of the Invention

The invention proceeds from an agitator device having at least one carrier unit, which has at least one connection element for a connection to a drive shaft and at least one beam element for the fastening of at least one agitator blade.

It is proposed that the beam element and the connection element are connected to one another in a one-part implementation.

Alternatively or advantageously in addition, it is proposed that the beam element has at least one portion with an at least substantially quadrilateral cross section.

By means of the embodiment according to the invention, an advantageous design can be achieved. Furthermore, an agitator device which is inexpensive and/or easy to manufacture can be provided. Furthermore, an agitator device can be provided which can be cut out of a sheet, wherein, in particular, the number of required welding processes can be reduced and/or strength can be increased. In particular, a hub and struts of an agitator device can be manufactured from a common workpiece, wherein the agitator device is advantageously of seamless form. Furthermore, high flexibility can be achieved with regard to a connection of an agitator blade. In particular, an agitator blade can be easily attached to a carrier strut. It is advantageously possible to at least almost completely dispense with milling machining during a production process. Furthermore, a strut can be provided which has an advantageous geometry, in particular with regard to simple production and/or a flexible and/or simple connection of an agitator blade.

An "agitator device" is to be understood in particular to mean an in particular functional constituent part, in particular a structural and/or functional component, of an agitator appliance, for example of a mixer and/or of an agitator mechanism, in particular for a fluid, in particular with a maximum rotational speed of 500 rpm, advantageously of 200 rpm, particularly advantageously of 100 rpm, preferably of 50 rpm. In particular, the agitator device may also comprise the entire agitator appliance. The agitator device is advantageously a constituent part of an agitator body or implemented as an agitator body. The agitator device is particularly advantageously provided for being rotated about an axis of rotation, in particular during an agitation process. The agitator device is preferably of point-symmetrical form, in particular with respect to a central point of the connection element. It is particularly preferable if, in an installed state of the agitator device, the axis of rotation of the agitator device runs through the central point of the connection element. It is advantageously the case that, in an installed state, the axis of rotation runs parallel to the vertical direction, in particular in a normal operating state of the agitator appliance, wherein the vertical direction runs preferably perpendicular to an underlying surface.

The carrier unit is preferably embodied in a one-part implementation. The carrier unit is particularly preferably realized at least predominantly and in particular completely from a metal, for example from steel and/or high-grade steel and/or from an alloy and/or from any other desired metal such as for example aluminum and/or titanium. It is however also conceivable for the agitator unit to be manufactured at least predominantly from a plastic. It is furthermore conceivable for the agitator unit to have an, in particular additional, at least partial coating, for example with a metal oxide and/or an in particular corrosion-resistant polymer, and/or to be of rubber-lined form. Here, the expression "at least predominantly" is to be understood in particular to mean at least 55%, advantageously at least 65%, preferably at least 75%, particularly preferably at least 85% and particularly advantageously at least 95%.

The connection element, or all of the connection elements of the carrier unit, and the beam element, or all of the beam elements of the carrier unit, preferably form the carrier unit.

The connection element advantageously forms a part, in particular an upper part, of a hub. The connection element is particularly advantageously implemented at least predominantly, in particular entirely, from a metal, for example from steel and/or from high-grade steel, and/or from the same material as the carrier unit. It is conceivable for the carrier unit to have multiple connection elements, in particular with corresponding cross sections, which are advantageously arranged one above the other, and which together form the hub.

The beam element is advantageously implemented at least predominantly, in particular entirely, from a metal, for example from steel and/or from high-grade steel, and/or from the same material as the carrier unit. In particular, the beam element is of elongate form. The beam element is preferably of straight form. The beam element is particularly advantageously of rod-like form. In particular, the beam element, in particular a longitudinal direction of the beam element, extends, proceeding from a central point of the connection element, in particular in a straight manner in a radial direction of the agitator device. The beam element preferably runs in a plane, in particular in a plane perpendicular to the axis of rotation. In particular, the beam element has a longitudinal extent which corresponds to at least 5%, advantageously at least 10%, particularly advantageously at least 20% and preferably at least 30% of a maximum extent, in particular of a diameter, of the agitator device. It is also conceivable for the beam element to be of bent form, wherein the beam element may be realized so as to be curved within the plane and/or out of the plane. The beam element advantageously has at least one connection region for the agitator blade, wherein the connection region is particularly advantageously provided for welding to and/or screwing to and/or riveting to, and/or for a connection in a one-part implementation and/or for some other connection, to the agitator blade. The beam element preferably forms a strut to which an agitator blade is attachable or attached. In particular, the strut corresponds to the beam element. It is also conceivable for the carrier unit to have a multiplicity of beam elements which are advantageously arranged one above the other, in particular with corresponding cross sections, which beam elements together form a strut. Here, the carrier unit may have a multiplicity of struts which are in particular each implemented by multiple beam elements, which are preferably arranged one above the other. "Configured" is in particular to mean specifically designed and/or equipped. A statement that an object is configured for a particular function is to be understood in particular to mean that the object performs and/or carries out this particular function in at least one usage and/or operating state.

"In a one-part implementation" is in particular to mean formed in one piece. Said one piece is preferably produced from a single workpiece and/or from a single blank and/or one mass and/or one casting, or in an injection molding process, in particular in a single-component and/or multi-component injection molding process. It is for example conceivable for the carrier unit to be implemented such that it can be manufactured as a single forged part. It is also conceivable for the carrier unit to be formed as a cast part.

An "at least substantially quadrilateral/rectangular cross section" of an object is to be understood here in particular to mean that, for at least 60%, advantageously for at least 70%, particularly advantageously for at least 80% preferably for at least 90% of all cross sections of the object along at least one direction, an area of a differential area of the cross section and of a smallest, advantageously non-crossed quadrilateral/rectangle which surrounds the cross section amounts to at most 30%, advantageously at most 20%, particularly advantageously at most 10%, preferably at most 5% and particularly advantageously at most 3% of the area of the quadrilateral/rectangle.

The portion is preferably of cuboidal form. The portion particularly preferably comprises at least a predominant part of the beam element and in particular the entire beam element. The beam element is advantageously rectangular. Here, "rectangular" is basically also intended to encompass geometrical shapes which correspond to rectangles with rounded and/or beveled corners. The beam element is particularly advantageously of cuboidal form, wherein, in particular, rounded and/or beveled edges are likewise conceivable. By means of a rounding or a corresponding bevel, it is possible in particular for a notch effect to be reduced.

The beam element may also have a cross section which differs from a rectangle. In particular, the cross section may be a quadrilateral which differs from a rectangle, such as for example a parallelogram with internal angles that differ from 90°, or a trapezoid or any desired, advantageously non-crossed quadrilateral.

In one advantageous embodiment of the invention, it is proposed that the beam element and the connection element have an at least substantially identical material thickness in a common connection region, in particular in a view perpendicular to the axis of rotation. In particular, in the connection region, material thickness of the beam element corresponds to the material thickness of the connection element. The beam element and the connection element advantageously have an at least substantially identical extent along the axis of rotation in the connection region. The connection element advantageously transitions seamlessly into the beam element. The connection element particularly advantageously has an at least substantially constant material thickness, in particular in a view perpendicular to the axis of rotation. The material thickness of the connection element roughly corresponds to the material thickness of that portion of the beam element which has an at least substantially quadrilateral cross section. In this context, "at least substantially" to be understood in particular to mean that a deviation from a predefined value corresponds in particular to less than 15%, preferably less than 10% and particularly preferably less than 5% of the predefined value. In this way, a geometry can be provided which is easy to manufacture. Furthermore, in this way, it is possible to realize a high load capacity, in particular of a connection between a hub and a strut.

In a particular advantageous embodiment of the invention, it is proposed that the connection element and the beam element are produced from a common plate-like workpiece, in particular from a sheet or a plate, advantageously a metal sheet or a metal plate. The plate-like workpiece has in particular the same material as the carrier unit, and may for example be implemented at least partially, in particular entirely, of a plastic or a composite material. It is advantageous for the entire carrier unit to be produced from the plate-like workpiece. The beam element and the connection element, advantageously the entire carrier unit or at least the corresponding blank, are advantageously realized as a common flat part, for example as a cut flat part or as a punched flat part. In this way, it is advantageously possible to realize inexpensive producibility. Furthermore, in this way, high flexibility can be achieved with regard to usable production methods and/or usable materials.

In a further refinement of the invention, it is proposed that the connection element forms at least one connection flange which is configured for an in particular detachable connection to a shaft flange, in particular a shaft flange of the drive shaft. The connection flange is advantageously configured for being screwed to a shaft flange. The connection element advantageously has an in particular cylindrical recess which advantageously surrounds the connection flange. It is particularly advantageous if, in an installed state, the axis of rotation runs through the recess. In this way, it is possible to realize advantageous characteristics with regard to an installation capability and/or easy maintenance and/or the possibility of flexible conversion.

It is conceivable for a connection between the connection element and the drive shaft to comprise at least one force screw and/or at least one parallel key connection. It is also conceivable for the connection element to be configured for being connected by means of a clamping connection to the drive shaft. Alternatively or in addition, it is conceivable for the connection element to be adhesively bonded to the drive shaft. Further connection variants that would appear suitable to a person skilled in the art are self-evidently also conceivable.

In a preferred embodiment of the invention, it is proposed that the beam element has, in at least one direction, a tapering cross section. In particular, the cross section of the beam element tapers in an advantageously radially running direction away from the connection element. The beam element advantageously has at least one first portion with a constant, in particular at least substantially rectangular, cross section, which particularly advantageously adjoins the connection element. The beam element particularly advantageously has at least one second portion with in particular at least substantially rectangular, tapering cross section. It is conceivable for the first portion and the second portion to join one another. The beam element preferably has at least one third portion with in particular at the substantially rectangular, constant cross section, which is smaller than a cross section of the first portion. It is conceivable for the second portion and the third portion to join one another. In this way, it is advantageously possible for a geometry to be adapted to a load. In particular, in this way, it is possible to provide a geometry which can be flexibly adapted to a corresponding demand.

It is furthermore proposed that the beam element is realized so as to be twisted at least section-wise, for example by an angle of at least 5° or of at least 10° or of at least 15° or of at least 20° or of at least 30° or of at least 45° or of at least 60° or of at least 75 or by a greater angle. In particular, the beam element has an inherent twist at least section-wise. The beam element advantageously has at least one first portion which is oriented in a straight manner with respect to the connection element. The beam element particularly advantageously has at least one second portion which is arranged so as to be tilted with respect to the second connection element. It is preferable for the second, tilted portion to be configured for the fastening of the agitator blade, such that said agitator blade is advantageously inclined relative to an agitating direction during an agitation process. A further beam element, arranged opposite the beam element, of the carrier unit is particularly preferably realized so as to be twisted in an opposite direction, in particular the same angle. The strut is preferably implemented such that it can be produced by cutting out/punching out of the plate-like workpiece and subsequent testing. In this way, it is advantageously possible for an angle of inclination of an agitator blade to be adapted in a simple and/or inexpensive and/or variable manner.

It is furthermore proposed that the agitator device comprises at least one agitator blade which is connected to the beam element. The carrier unit particularly preferably comprises at least one second beam element which is in particular arranged opposite the beam element. The agitator device advantageously comprises at least one further agitator blade, which is fastened to the second beam element. The agitator device preferably comprises, at least one, advantageously exactly one, agitator blade per beam element, which agitator blade is fastened to the corresponding beam element. It is particularly preferable for the carrier unit to comprise exactly two beam elements and for the agitator device to comprise exactly two agitator blades, which are advantageously fastened in each case to one of the beam elements. It is conceivable for the agitator device to have a multiplicity of carrier units, which are in particular arranged one above the other. Agitator device with a total number of N agitator blades may in this case advantageously comprise a number of N/2 carrier units with in each case two agitator blades, which are particularly advantageously arranged at uniform angles with respect to one another, for example at angles of 720°/N, wherein the agitator blades are in particular in this case arranged preferably at regular intervals in a circle in a view parallel to the axis of rotation. In particular in the case of a stack of multiple carrier units, lower carrier units are realized such that, in a central region, in particular in a region of their respective connection element, they are fastened and/or fastenable to a carrier unit arranged respectively thereabove, and/or to the drive shaft. It is however also conceivable for the carrier unit to comprise three or four or five or six or more beam elements, and advantageously a corresponding number of agitator blades. In this way, it is possible to provide a geometry which is easy to manufacture. Furthermore, in this way, characteristics relating to an agitation process can be adapted to the requirements.

In one advantageous embodiment of the invention, it is proposed that the agitator blade is connected to the beam element along a longitudinal side of said beam element. In particular, the agitator blade is connected along its front longitudinal side to the beam element. The agitator element may be welded and/or screwed and/or adhesively bonded and/or connected in some other way to the beam element. The agitator blade preferably has at least one in particular L-shaped outer contour, in the region of which said agitator blade is connected to the beam element. Here, it is in particular conceivable for the outer contour to be of L-like form, wherein limbs of the imaginary "L" includes an angle which differs from 90°, for example an in particular considerably smaller angle, such as for example 75° or 60° or 45°, or an in particular considerably greater angle, such as for example 105° or 120° or 150°. It is particularly advantageous that a relatively long portion of the outer contour runs at least substantially parallel to a main direction of extent of the beam element. In particular, the relatively long portion of the outer contour bears, preferably over its entire length, against the longitudinal side of the beam element. Here, "at least substantially parallel" is to be understood in particular to mean an orientation of a direction relative to a reference direction, in particular in a plane, wherein the direction has a deviation of in particular less than 8°, advantageously less than 5° and particularly advantageously less than 2° relative to the reference direction. A "main direction of extent" of an object is to be understood here in particular to mean a direction which runs parallel to a longest edge of a smallest imaginary cuboid which just completely encloses the object. In this way, it is advantageously possible to achieve a high load-bearing capacity of an agitator blade connection.

In a particularly advantageous embodiment of the invention, it is proposed that a leading edge of the agitator blade terminates flush, at least section-wise, with at least one edge of the beam element. The leading edge preferably extends from a front side of the beam element in a direction facing away from the connection element and in particular parallel to a main direction extent of the beam element. The leading edge of the agitator blade particularly preferably forms an elongation of the edge of the beam element. The leading edge is advantageously configured for being arranged at the front in an agitating direction during an agitation process. In this way, expedient agitation characteristics can advantageously be achieved.

In a preferred embodiment of the invention, it is proposed that the agitator blade and the beam element are connected to one another on a front side of the beam element. In particular, the agitator blade bears with a relatively short portion of the in particular L-shaped outer contour, preferably over its entire length, against the front side of the beam element. The agitator blade is preferably connected along the outer contour to the beam element. The agitator blade is particularly preferably welded along its outer contour to the beam element, in particular along the entire length of the outer contour. In this way, it is advantageously possible to achieve a high bending stiffness of an agitator blade connection.

Alternatively or in addition, it is proposed that the beam element and the agitator blade are connected to one another in a one-part implementation. In particular, the beam element and the agitator blade are manufactured from a common, preferably plate-like workpiece, wherein the agitator blade is advantageously realized so as to be bent out of a plane relative to the beam element. The material thickness of the agitator blade advantageously corresponds at least substantially to the material thickness of the beam element. It is conceivable for the carrier element to have, above and/or below the beam element, advantageously plate-like and/or flat reinforcement elements, which are in particular arranged parallel to a main direction of extent of the beam element and/or are connected to said beam element. It is furthermore conceivable for the entire agitator device to be manufactured from a single plate-like workpiece, from which in particular the connection element, the beam element and the agitator blade, or all of the beam elements and all of the agitator blades, of the agitator device are cut out or punched out. In this way, it is advantageously possible to realize simple and/or fast and/or cost-efficient producibility.

It is furthermore proposed that at least a part of the carrier unit, in particular the entire carrier unit, is implemented by a layered structure with at least two sheets. For example, multiple sheets may be arranged so as to lie one on top of the other and in particular so as to be connected to one another, and may in particular form the entire carrier unit. For example, the carrier unit may comprise a central sheet which forms the beam element and the connection element. Furthermore, the carrier unit may comprise at least one reinforcement sheet which reinforces the central sheet, preferably in a region of the connection element and/or in a region of the beam element, and which in particular lies flat on the central region and/or is arranged above and/or below said central region. Multiple central sheets and/or multiple reinforcement sheets are basically also conceivable. For example, it is conceivable for the carrier unit to be constructed in the manner of a plywood panel from a multiplicity of sheets arranged in parallel. Here, edges that form may be rounded or beveled. Furthermore, oblique surfaces may be implemented by multiple sheets, in particular with beveled edges, arranged obliquely one above the other. In this way, it is advantageously possible to achieve high flexibility with regard to a design. Furthermore, in this way, it is possible to use simple and/or inexpensive production methods for producing an agitator device.

Advantageous characteristics with regard to a design and in particular inexpensive producibility can be achieved with an agitator appliance having at least one agitator device according to the invention.

Furthermore, the invention proceeds from a method for producing an agitator device, having at least one carrier unit which is at least one connection element for a connection to a drive shaft and at least one beam element for the fastening of at least one agitator blade.

It is proposed that the connection element and the beam element are produced from a common plate-like workpiece.

By means of a method according to the invention, it is possible to achieve advantageous characteristics with regard to production which is expedient from a manufacturing aspect. Furthermore, an agitator device which is inexpensive and/or easy to manufacture can be provided. Furthermore, an agitator device can be provided which can be cut out of a sheet, wherein, in particular, the number of required welding processes can be reduced and/or strength can be increased. In particular, a hub and struts of an agitator device can be manufactured from a common workpiece, wherein the agitator device is advantageously of seamless form. Furthermore, high flexibility can be achieved with regard to a connection of an agitator blade. In particular, an agitator blade can be easily attached to a carrier strut. It is advantageously possible to at least almost completely dispense with milling machining during a production process. Furthermore, a strut can be provided which has an advantageous geometry, in particular with regard to simple production and/or a flexible and/or simple connection of an agitator blade.

It is preferable for the entire carrier unit to be produced from the plate-like workpiece. It is particularly preferable for a carrier unit blank to be cut out or punched out of the plate-like workpiece and advantageously subsequently machined, for example by virtue of edges being beveled and/or rounded. Furthermore, for example, the recess in the region of the connection flange of the connection element is cut out or punched out. Cutting-out is advantageously performed by flame cutting, whereby in particular a need for edge machining and/or a need for milling machining is at least partially and advantageously completely eliminated. Any agitator blades of the agitator device are advantageously subsequently welded to the corresponding beam elements. It is also conceivable for at least one central sheet to be cut out or punched out, which central sheet forms a blank for the connection element, the beam element and the agitator blade and in particular for the entire carrier unit and all agitator blades. The central sheet is advantageously bent in certain regions in order to form the agitator blades. It is conceivable for reinforcement sheets to subsequently be cut out and/or punched out and connected to the central sheet and/or to one another.

In particular, the method according to the invention may comprise special method steps in which in each case at least one of the above-described features of the agitator device according to the invention and/or of the agitator appliance according to the invention is generated and/or added and/or implemented, in particular by means of a suitable manufacturing method.

Here, the agitator device according to the invention and the method according to the invention are not intended to be restricted to the uses and embodiments described above. In particular, the agitator device according to the invention and the method according to the invention may, in order to perform a function described herein, have a number of individual elements and/or components and/or units and/or method steps which differs from a number stated herein.

Furthermore, in the case of the value ranges stated in this disclosure, it is also intended that values lying within the stated limits are disclosed and usable as desired.

DRAWINGS

Further advantages will emerge from the following description of the drawings. The drawings illustrate five exemplary embodiments of the invention. The drawings, the description and the claims contain numerous features in combination. A person skilled in the art will expediently also consider the features individually and combine these to form further meaningful combinations.

Figure 2:
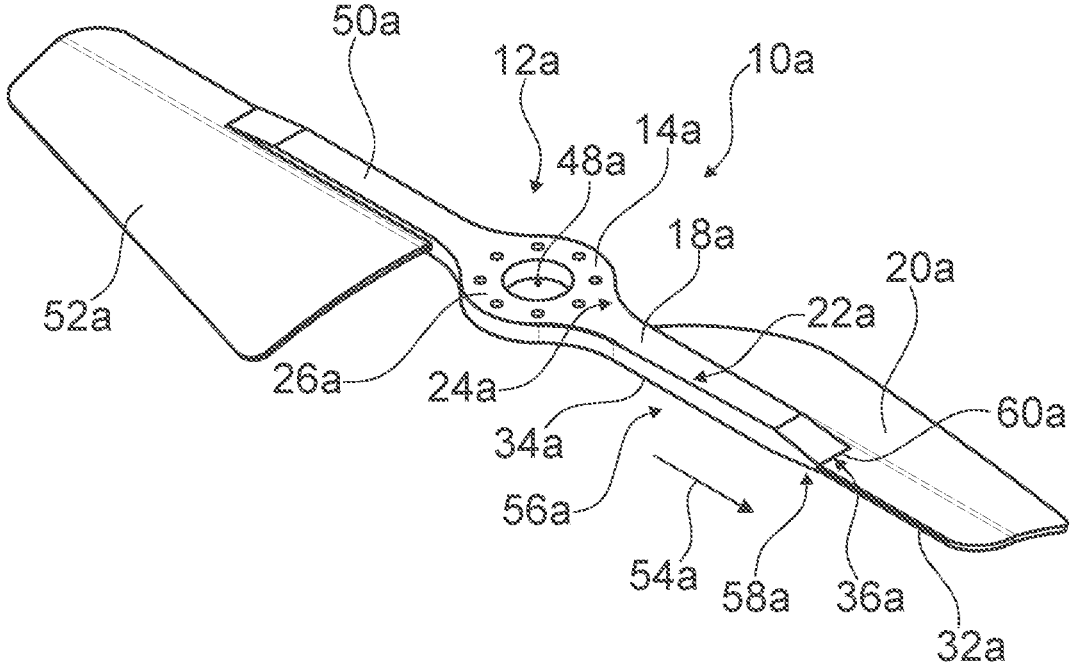
Figure 3:
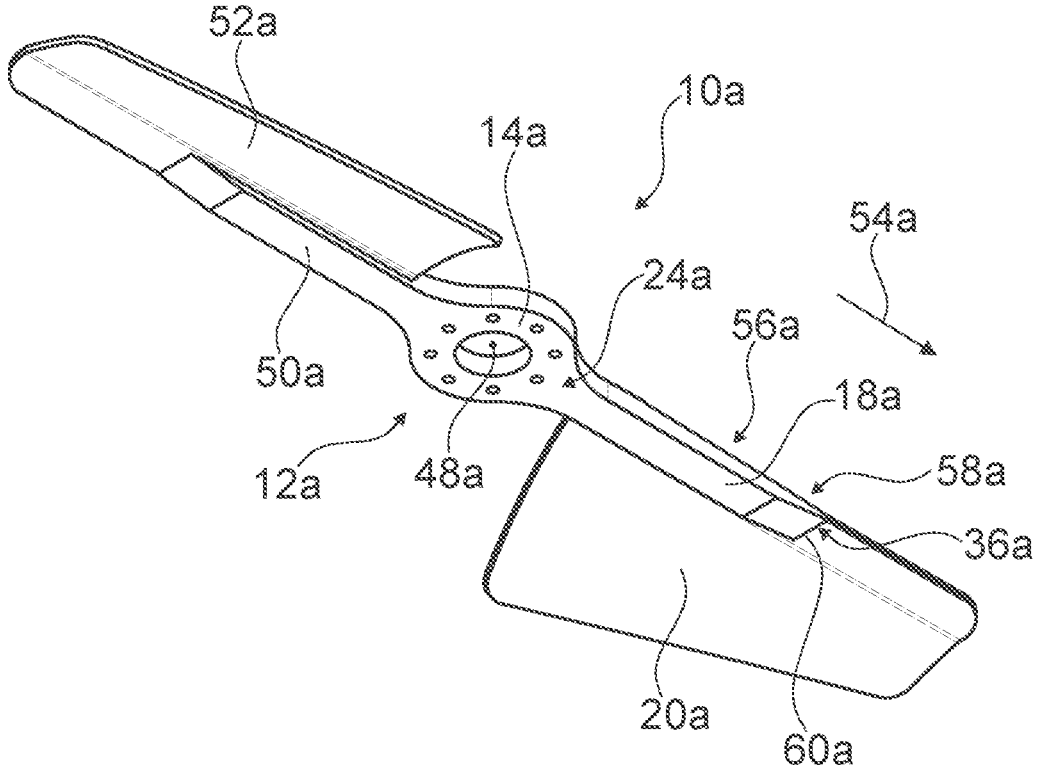
Figure 4:
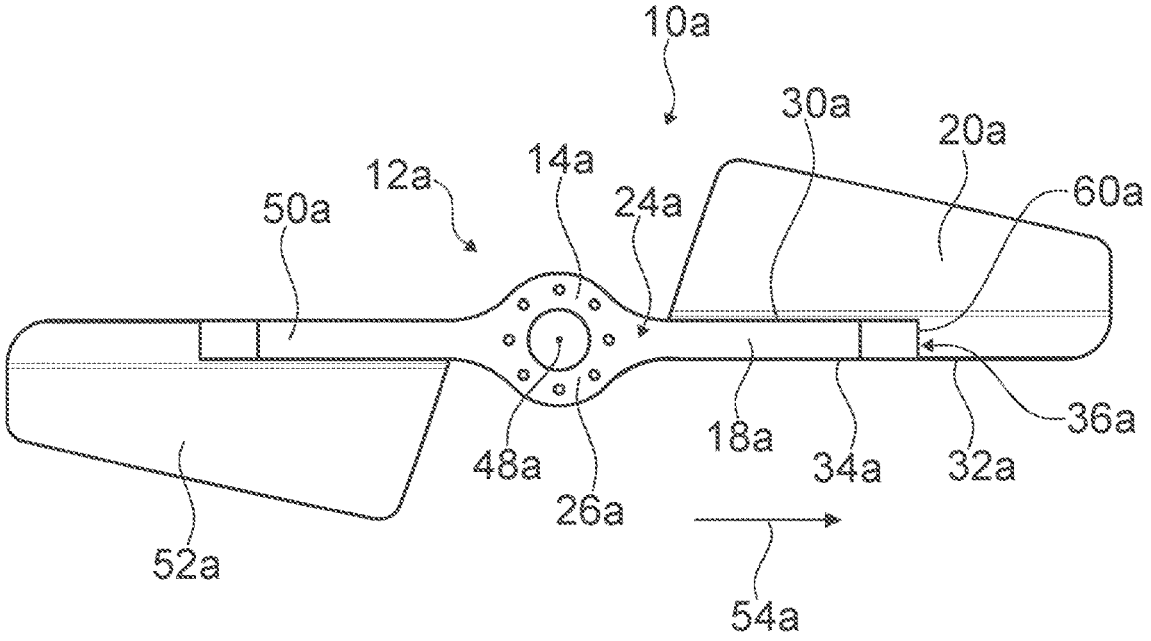
Figure 5:
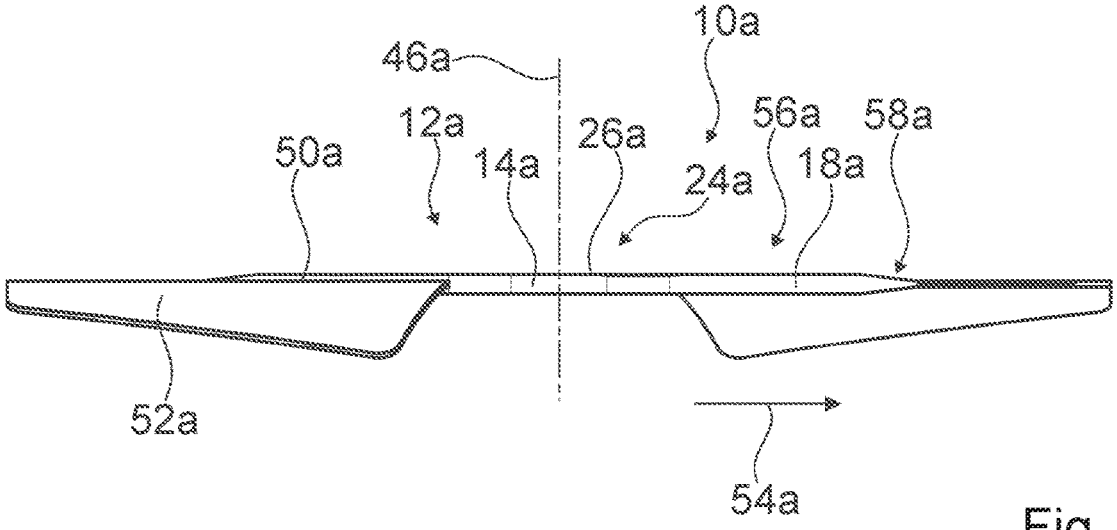
Figure 6:
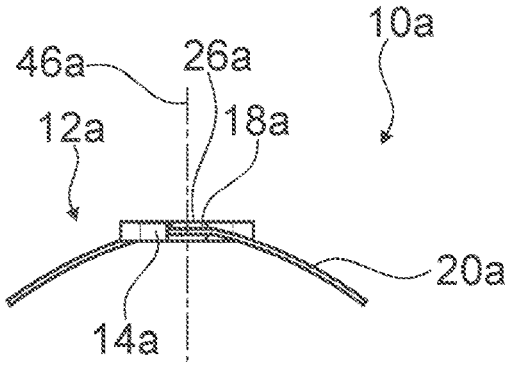
Figure 7:
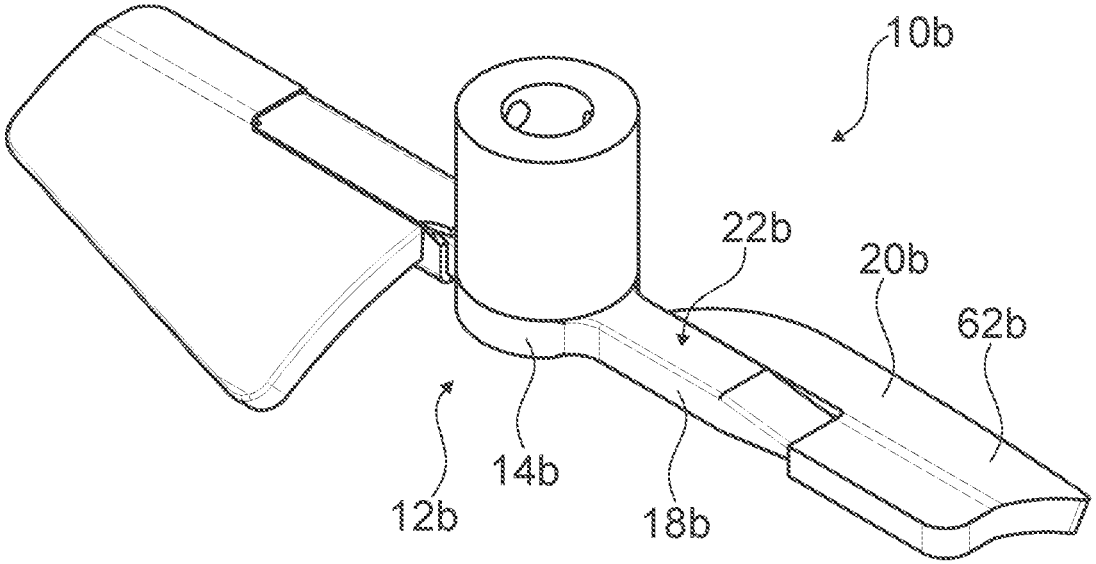
Figure 8:
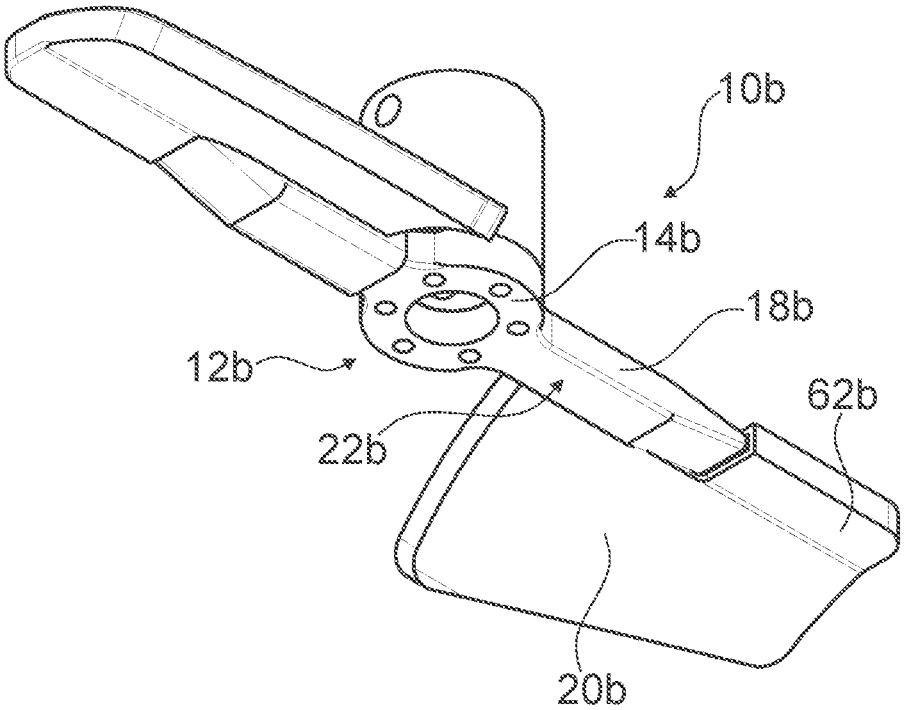
Figure 9:
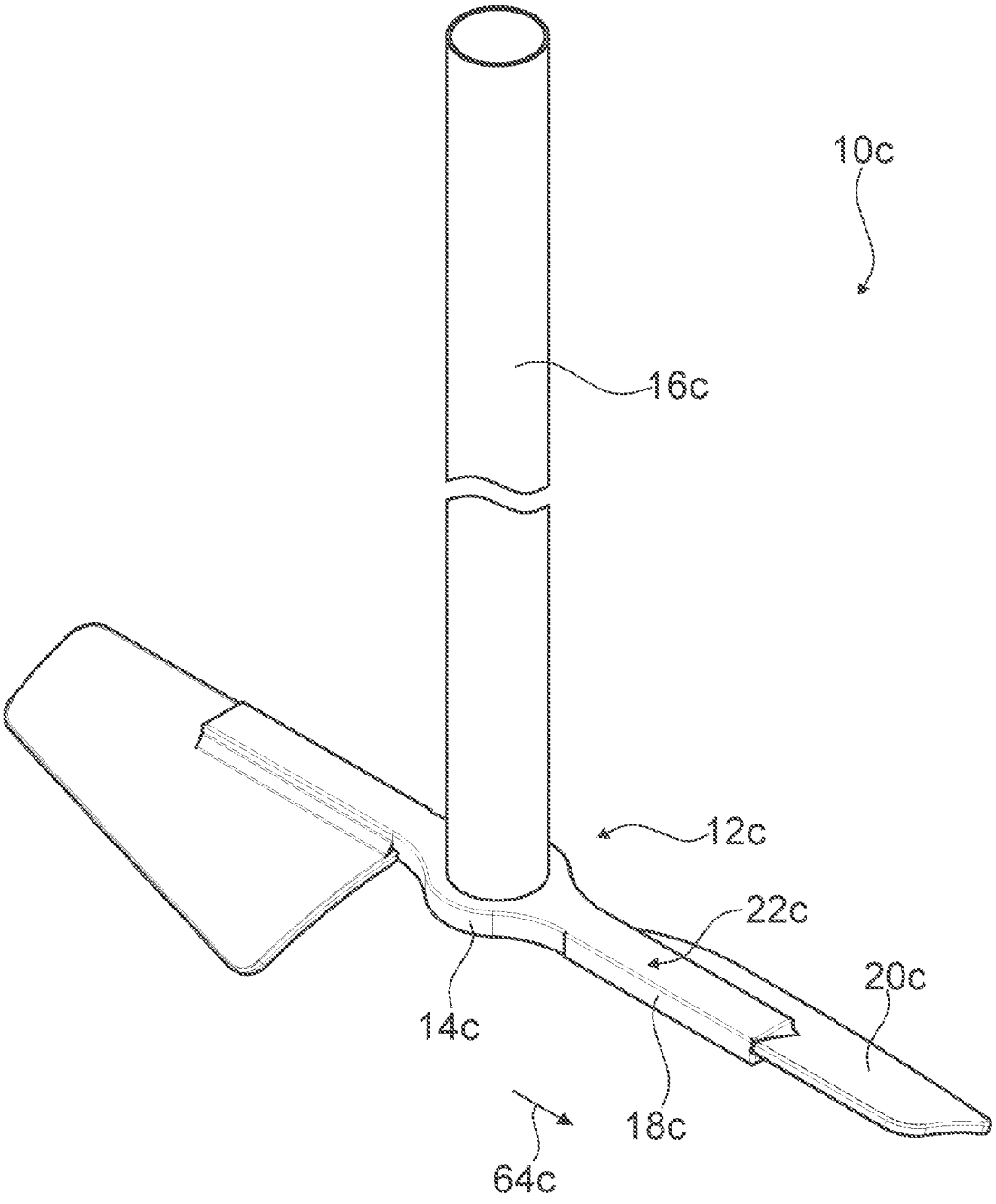
Figure 10:
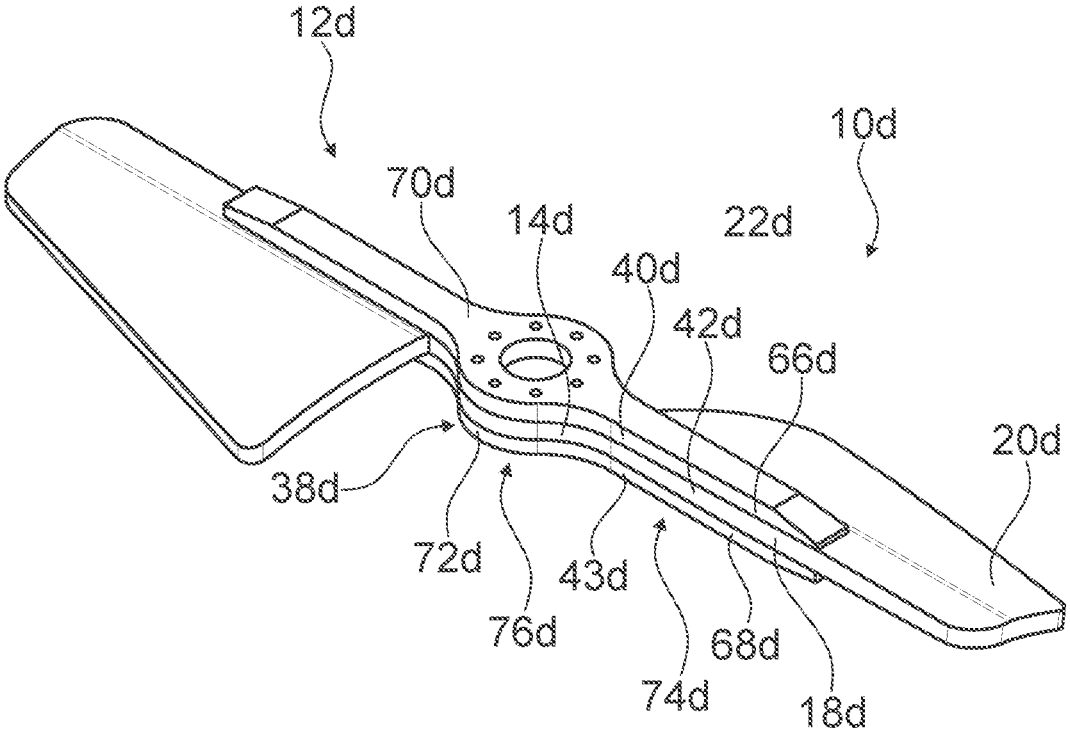
Figure 11:
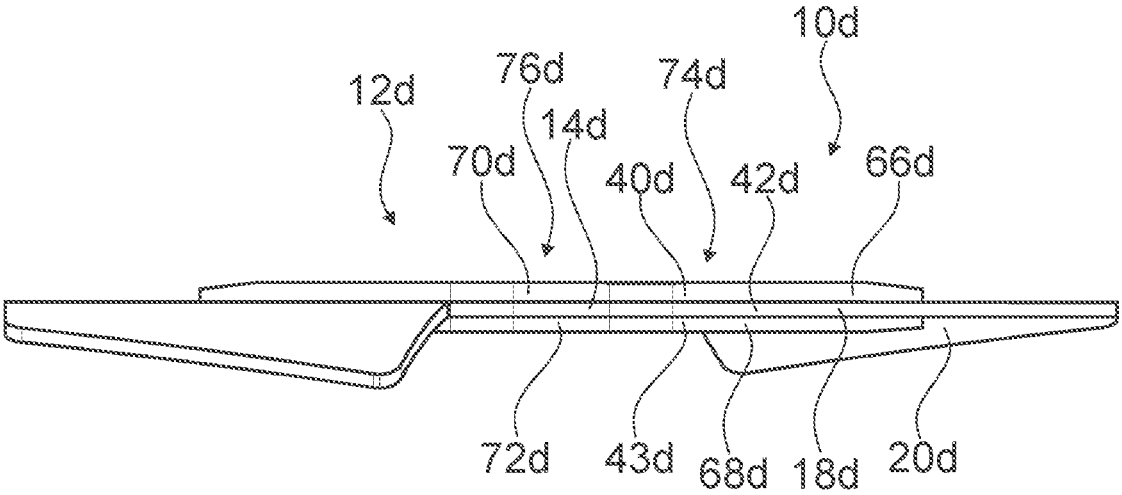
Figure 12:
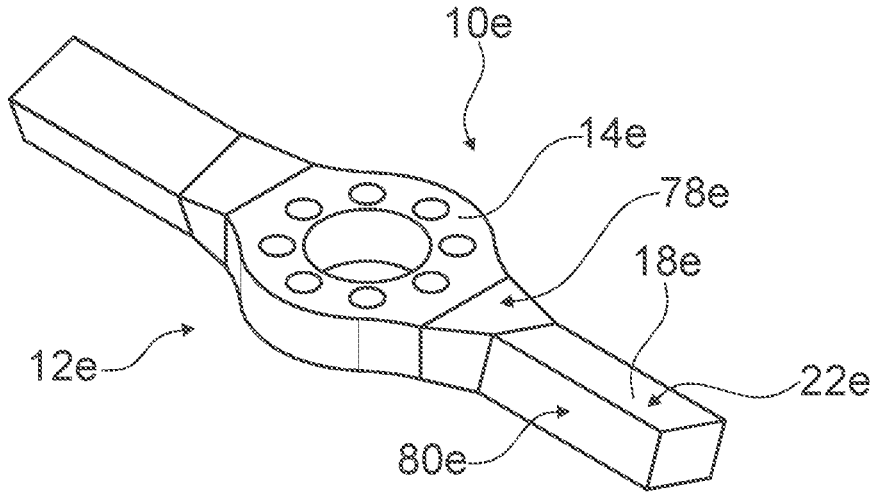
Figure 13:
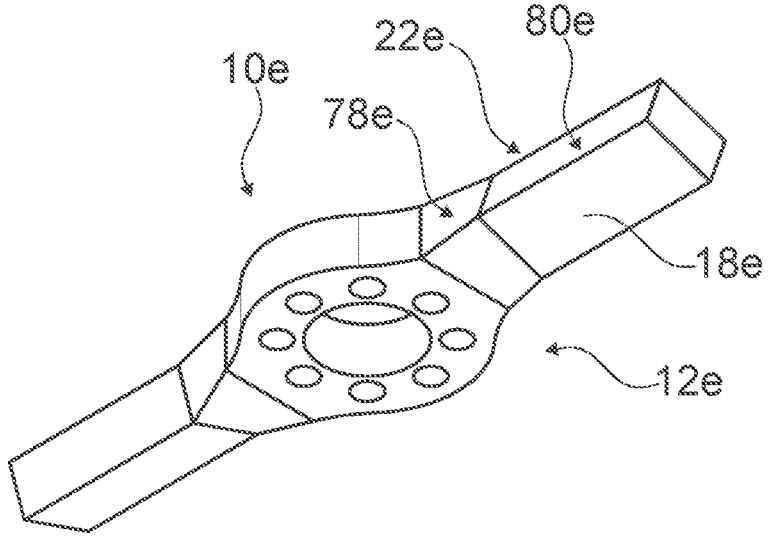
Figure 14:
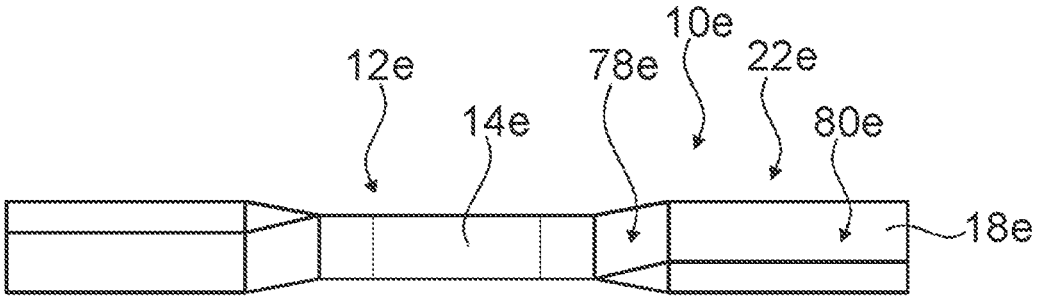
Figure 15:
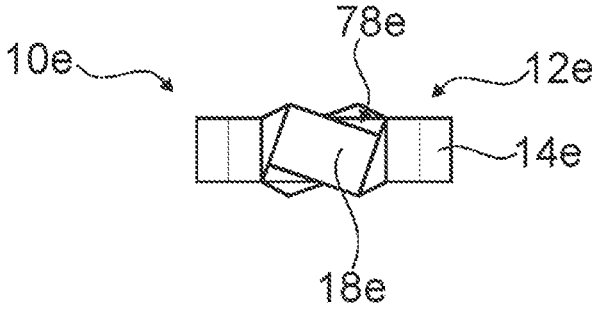
Figure 16:
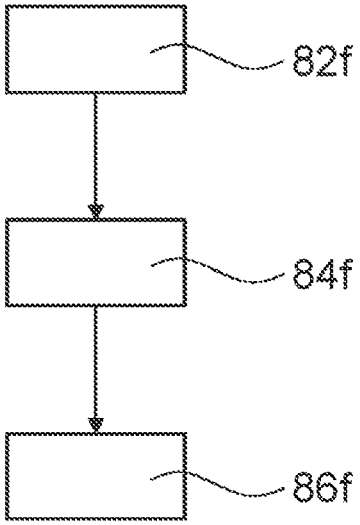

In the drawings:

FIG. 1 shows an agitator appliance with a first agitator device in a schematic illustration, FIG. 2 shows a top side of the first agitator device in a perspective illustration, FIG. 3 shows a bottom side of the first agitator device in a perspective illustration, FIG. 4 shows the first agitator device in a schematic plan view, FIG. 5 shows the first agitator device in schematic front view, FIG. 6 shows the first agitator device in a schematic side view, FIG. 7 shows a top side of a second agitator device in a perspective illustration, FIG. 8 shows a bottom side of the second agitator device in a perspective illustration, FIG. 9 shows a third agitator device in a perspective illustration, FIG. 10 shows a fourth agitator device in a perspective illustration, FIG. 11 shows the fourth agitator device in a schematic front view, FIG. 12 shows a top side of a fifth agitator device in a perspective illustration, FIG. 13 shows a bottom side of the fifth agitator device in a perspective illustration, FIG. 14 shows the fifth agitator device in schematic front view, FIG. 15 shows the fifth agitator device in a schematic side view, and FIG. 16 shows a schematic flow diagram of a method for producing an agitator device.

DESCRIPTION OF THE EXEMPLARY EMBODIMENTS

FIG. 1 shows an agitator appliance 44*a* with a first agitator device 10*a* in a schematic illustration. The first agitator device 10*a* is in the present case in the form of an agitator body. The first agitator device 10*a* is fastened to a drive shaft 16*a* of the agitator appliance 44*a*. The first agitator device 10*a* is fastened to a shaft flange 28*a* of the drive shaft 16*a*. The first agitator device 10*a* is designed to be rotatable about an axis of rotation 46*a*. In particular, the agitator device 10*a* is configured so as to rotate about the axis of rotation 46*a* during an agitation process. The axis of rotation 46*a* runs through a central point 48*a* of the first agitator device 10*a*. The axis of rotation 46*a* runs parallel to a longitudinal direction of the drive shaft 16*a*.

FIG. 2 shows a top side of the agitator device 10*a* in a perspective illustration. FIG. 3 shows a bottom side of the first agitator device 10*a* in a perspective illustration. FIGS. 4 to 6 show various additional schematic illustrations of the first agitator device 10*a*. The first agitator device 10*a* has a carrier unit 12*a*. The carrier unit 12*a* comprises an connection element 14*a* for a connection to the drive shaft 16*a*.

Furthermore, the carrier unit 12*a* comprises a beam element 18*a* for the fastening of at least one agitator blade 20*a*. The beam element 18*a* forms a strut for the agitator blade 20*a*. The beam element 18*a* and the connection element 14*a* are connected to one another in a one-part implementation. In the present case, the carrier unit 12*a* is formed as a single piece. Furthermore, the carrier unit 12*a* is implemented from high-grade steel. Other materials and/or material combinations are however also conceivable.

The beam element 18*a* has a portion 22*a* with an at least substantially quadrilateral cross section. In the present case, the portion 22*a* has a rectangular cross section. Furthermore, in the present case, the entire beam element 18*a* has a substantially quadrilateral, in particular rectangular, cross section. The edges of the beam element 18*a* are beveled at least section-wise.

In the present case, the carrier unit 12*a* comprises a further beam element 50*a*. The further beam element 50*a* is of point-symmetrical design relative to the beam element 18*a* about the central point 48*a* of the agitator device 10*a*. The first agitator device 10*a* has the agitator blade 20*a*. The agitator blade 20*a* is fastened to the beam element 18*a*. Furthermore, in the present case, the first agitator device 10*a* has a further agitator blade 52*a*. The further agitator blade 52*a* is fastened to the further beam element 50*a*. The further agitator blade 52*a* is of point-symmetrical design relative to the agitator blade 20*a* about the central point 48*a* of the first agitator device 10*a*. The beam element 18*a*, the further beam element 50*a* and the connection element 14*a* together form the carrier unit 12*a*. The carrier unit 12*a*, the agitator blade 20*a* and the further agitator blade 52*a* together form the agitator device 10*a*.

In the present case, the first agitator device 10*a* has a longitudinal extent of approximately 4 m. The longitudinal extent corresponds to a diameter of the agitator device 10*a*. Other dimensions of an agitator device are however also conceivable, in particular different ratios of a length, a width and a height. For example, a longitudinal extent of an agitator device may amount to 0.1 m or 0.5 m or 1 m or 2 m or 3 m or 5 m or 6 m or even more. Furthermore, in the present case, the beam element 18*a* has a longitudinal extent of approximately 1 m. Other longitudinal extents of a beam element are however also conceivable, in particular in a similar length ratio relative to the longitudinal extent of the agitator device 10*a* as in the present case, or else in some other length ratio.

The connection element 14*a* and the beam element 18*a* are produced from a common plate-like workpiece. In the present case, the common workpiece is a high-grade steel plate. Other suitable materials are self-evidently also conceivable. A thickness of the workpiece furthermore amounts in the present case to approximately 7 cm. Other thicknesses are however also conceivable, such as for example 0.1 cm or 1 cm or 2 cm or 4 cm or 6 cm or 8 cm or 10 cm or 15 cm or more or less or any thicknesses lying between the stated values. In the present case, the further beam element 50*a* is additionally produced from the common plate-like workpiece. The carrier unit 12*a* is produced from the common plate-like workpiece, in particular by being cut out or punched out.

The beam element 18*a* and the connection element 14*a* have an at least substantially identical material thickness and a common connection region 24*a*. In the present case, the material thickness amounts to approximately 7 cm. The material thickness corresponds at least substantially to a thickness of the common plate-like workpiece. The connection element 14*a* transitions into the beam element 18*a* in the connection region 24*a*. Furthermore, the connection element 14*a* and the beam element 18*a* have an at least substantially identical width in the connection region 24*a*. Furthermore, the connection element 14*a* and the beam element 18*a* have an at least substantially identical cross section in the connecting region 24*a*.

The connection element 14*a* forms an connection flange 26*a*, which is configured for a connection to the shaft flange 28*a*. In an installed state, the connection flange 26*a* is screwed to the shaft flange 28*a*.

The beam element 18*a* has, in at least one direction 54*a*, a tapering cross section. In the present case, the direction 54*a* corresponds to a radial direction with respect to the axis of rotation 46*a*. Furthermore, the beam element 18*a* has, in the present case, a first portion 56*a* with a constant rectangular cross section and, joining this, a second portion 58*a* with a tapering rectangular cross section.

The agitator blade 20*a* is connected to the beam element 18*a* along a longitudinal side 30*a* of said beam element. The agitator blade 20*a* is welded to the beam element 18*a*. Other connection types are however also conceivable, as described above. The agitator blade 20*a* has an L-shaped outer contour 60*a*, which is connected to the beam element 18*a*. The L-shaped outer contour 60*a* is adapted to an outer contour of the beam element 18*a*. A long limb portion of the outer contour 60*a* lies against the longitudinal side 30*a* of the beam element 18*a*.

The agitator blade 20*a* and the beam element 18*a* are connected to one another on a front side 36*a* of the beam element 18*a*. In the present case, the agitator blade 20*a* is welded to the front side 36*a* of the beam element 18*a*. A short limb portion of the outer contour 60*a* of the agitator blade 20*a* lies against the front side 36*a* of the beam element 18*a*. Alternatively or in addition, it is conceivable for a beam element to form, in particular on a front side, a slit into which at least a part of the agitator blade is inserted. The agitator blade may then be clamped and/or welded to the beam element.

A leading edge 32*a* of the agitator blade 20*a* terminates flush, at least section-wise, with an edge 34*a* of the beam element 18*a*. The edge 34*a* is a leading edge of the beam element 18*a*. In the present case, the leading edge 32*a* of the agitator blade 20*a* forms an elongation of the edge 34*a* of the beam element 18*a*.

FIGS. 7 to 15 show four further exemplary embodiments of the invention. The following descriptions and the drawings are restricted substantially to the differences between the exemplary embodiments, wherein, with regard to identically designated components, in particular with regard to components with identical reference designations, reference may basically also be made to the drawings and/or to the description of the other exemplary embodiments, in particular of FIGS. 1 to 6. To distinguish between the exemplary embodiments, the alphabetic character a has been added as a suffix to the reference designations of the exemplary embodiments in FIGS. 1 to 6. The alphabetic character a has been replaced by the alphabetic characters b to f in the exemplary embodiments of FIGS. 7 to 15.

FIGS. 7 and 8 show perspective illustrations of a second agitator device 10*b*. The second agitator device 10*b* has a carrier unit 12*b*. The carrier unit 12*b* comprises an connection element 14*b* for a connection to a drive shaft (not shown). Furthermore, the carrier unit 12*b* comprises a beam element 18*b* for the fastening of at least one agitator blade 20*b*. The second agitator device 10*b* has the agitator blade 20*b*. The beam element 18*b* and the connection element 14*b* are connected to one another in a one-part implementation. In the present case, the carrier unit 12*b* is formed as a single piece.

The beam element 18*b* has a portion 22*b* with an at least substantially quadrilateral cross section. In the present case, the portion 22*b* has a rectangular cross section. Furthermore, in the present case, the entire beam element 18*b* has a substantially quadrilateral, in particular rectangular, cross section. The edges of the beam element 18*b* are beveled at least section-wise.

In the present case, the agitator blade 20*b* has a rubber coating. The agitator blade 20*b* is basically designed, and fastened to the beam element 18*b*, analogously to the agitator blade 20*a* from the exemplary embodiment of FIGS. 1 to 6. However, in the present case, a rubber coating 62*b* has been pulled over a metallic main body of the agitator blade 20*b*. The material and material thickness of the rubber coating 62*b* and the size thereof can be easily and/or inexpensively adapted to a use.

FIG. 9 shows a third agitator device 10*c* in a perspective illustration. The third agitator device 10*c* has a carrier unit 12*c*. The carrier unit 12*c* comprises an connection element 14*c* for a connection to a drive shaft 16*c*. Furthermore, the carrier unit 12*c* comprises a beam element 18*c* for the fastening of at least one agitator blade 20*c*. The third agitator device 10*c* has the agitator blade 20*c*. The beam element 18*c* and the connection element 14*c* are connected to one another in a one-part implementation. In the present case, the carrier unit 12*c* is formed as a single piece.

The beam element 18*c* has a portion 22*c* with an at least substantially quadrilateral cross section. In the present case, the portion 22*c* has a rectangular cross section. Furthermore, in the present case, the entire beam element 18*c* has a substantially quadrilateral, in particular rectangular, cross section. The edges of the beam element 18*c* are beveled at least section-wise.

In the present case, the beam element 18*c* is of cuboidal form. A cross section of the beam element 18*c* is constant. The cross section of the beam element 18*c* is invariant along a longitudinal direction 64*c* of the beam element 18*c*. The longitudinal direction 64*c* of the beam element 18*c* corresponds to a radial direction. Such an embodiment is particularly easy to produce. In particular, the carrier unit 12*c* may be cut out or punched out of a plate-like workpiece, advantageously without the need to form bevels at certain locations.

FIGS. 10 and 11 show different illustrations of a fourth agitator device 10*d*. The fourth agitator device 10*d* has a carrier unit 12*d*. The carrier unit 12*d* comprises an connection element 14*d* for a connection to a drive shaft (not shown). Furthermore, the carrier unit 12*d* comprises a beam element 18*d* for the fastening of at least one agitator blade 20*d*. The fourth agitator device 10*d* has the agitator blade 20*d*. The beam element 18*d* and the connection element 14*d* are connected to one another in a one-part implementation. In the present case, the carrier unit 12*d* is formed as a single piece.

The beam element 18*d* has a portion 22*d* with an at least substantially quadrilateral cross section. In the present case, the portion 22*d* has a rectangular cross section. Furthermore, in the present case, the entire beam element 18*d* has a substantially quadrilateral, in particular rectangular, cross section. The edges of the beam element 18*d* are beveled at least section-wise.

At least a portion of the carrier unit 12*d* is realized by a layered structure 38*d* with at least two sheets 40*d*, 42*d*, 43*d*. In the present case, the entire carrier unit 12*d* is realized by the layered structure 38*d*. Furthermore, in the present case, the layered structure 38*d* comprises a first sheet 40*d*, a second sheet 42*d* and a third sheet 43*d*. The sheets 40*d*, 42*d*, 43*d* are implemented from high-grade steel. The second sheet 42*d* is in the present case realized as a central sheet. The second sheet 42*b* has the connection element 14*d* and the beam element 18*d*.

The first sheet 40*d* is realized as an upper reinforcement sheet. The third sheet 43*d* is realized as a lower reinforcement sheet. The first sheet 40*d* and the third sheet 43*d* each have further beam elements 66*d*, 68*d* and further connection elements 70*d*, 72*d*. The beam elements 18*b*, 66*d*, 68*d* together form a strut 74*d* of the carrier unit 12*d*. The connection elements 14*d*, 70*d*, 72*d* together form a shaft connection unit 76*d* of the carrier unit 12*d* for a connection to the drive shaft. The carrier unit 12*d* is constructed in the manner of a plywood panel from the sheets 40*d*, 42*d*, 43*d*.

The beam element 18*d* and the agitator blade 20*d* are connected to one another in a one-part implementation. The agitator blade 20*d* is part of the second sheet 42*d*. During production of the fourth agitator device 10*d*, the first sheet 40*d*, the second sheet 42*d* and the third sheet 43*d* are cut out or punched out from a starting sheet. Corners may be rounded or beveled if required. The sheets 40*d*, 42*d*, 43*d* are subsequently arranged one above the other and adhesively bonded and/or welded and/or screwed and/or riveted to one another. The second sheet 42*d* is deformed in targeted fashion in order to form the agitator blade 20*d*. The agitator blade 20*d* is curved out of a plane of the beam element 18*d* and of the connection element 14*d*.

FIGS. 12 to 15 show different illustrations of a fifth agitator device 10*e*. The fifth agitator device 10*e* has a carrier unit 12*e*. The carrier unit 12*e* comprises an connection element 14*e* for a connection to a drive shaft (not shown). Furthermore, the carrier unit 12*e* comprises a beam element 18*e* for the fastening of at least one agitator blade (not shown). The beam element 18*e* and the connection element 14*e* are connected to one another as one piece. In the present case, the carrier unit 12*e* is formed as a single piece.

The beam element 18*e* has a portion 22*e* with an at least substantially quadrilateral cross section. In the present case, the portion 22*e* has a rectangular cross section.

The beam element 18*e* is of twisted form at least section-wise. In the present case, the beam element 18*e* is of twisted form in a connection region 78*e* to the connection element 14*e*. The connection region 78*e* corresponds to a torsion region. A straight region 80*e* of the beam element 18*e* adjoins the connection region 78*e*. The straight region 80*e* of the beam element 18*e* is tested through approximately 20° relative to the connection element 14*e*. As indicated above, other angles are however also conceivable. An attached agitator blade is inclined during an agitation process owing to the torsion region of the carrier unit 12*e*. The inclination of an agitator blade can be performed easily through adaptation of the angle of twist. The carrier unit 12*e* may for example be produced by cutting or punching of a blank out of a plate-like workpiece and subsequent targeted twisting of parts of the blank.

FIG. 16 shows a schematic flow diagram of a method for producing an agitator device, for example one of the agitator devices of the preceding exemplary embodiments. The agitator device has a carrier unit which has an connection element for a connection to a drive shaft and has at least one beam element for the fastening of at least one agitator blade. In a first method step 82*f*, a common plate-like workpiece, for example a sheet, of a suitable thickness is provided. In a second method step 84*f*, the connection element and the beam element are produced from the common plate-like workpiece. In the present case, in the second method step 84*f*, a carrier unit blank is cut out of the workpiece. In a third method step 86*f*, finish machining is performed on the carrier unit blank in order to manufacture the carrier unit and in particular the agitator device. For example, in the third method step 86*f*, edges of the carrier unit may be rounded and/or beveled. It is furthermore conceivable that, in the third method step 86*f*, agitator blades are welded to the carrier unit and/or agitator blades are manufactured by bending of a sheet. It is self-evidently also conceivable for the third method step 86*f* to comprise a multiplicity of corresponding substeps.

REFERENCE DESIGNATIONS

10 Agitator device
12 Carrier unit
14 Connection element
16 Drive shaft
18 Beam element
20 Agitator blade
22 Portion
24 Connection region
26 Connection flange
28 Shaft flange
30 Longitudinal side
32 Leading edge
34 Edge
36 Front side
38 Layered structure
40 Sheet
42 Sheet
43 Sheet
44 Agitator appliance
46 Axis of rotation
48 Central point
50 Beam element
52 Agitator blade
54 Direction
56 Portion
58 Portion
60 Outer contour
62 Rubber coating
64 Longitudinal direction
66 Beam element
68 Beam element
70 Connection element
72 Connection element
74 Beam
76 Shaft connection unit
78 Connection region
80 Region
82 Method step
84 Method step
86 Method step

The invention claimed is:

1. An agitator device, comprising:

at least one carrier unit, which has at least one connection element for a connection to a drive shaft; and at least one beam element for the fastening of at least one agitator blade, wherein the beam element and the connection element are connected to one another in a one-part implementation, the connection element and the beam element are produced from a common plate-like workpiece, the connection element forms at least one connection flange, which is configured for a connection to a shaft flange, and the beam element has, in at least one direction, a tapering cross section, wherein the cross section of the beam element tapers in a radially running direction away from the connection element.

2. The agitator device as claimed in claim 1, wherein the beam element has at least one portion with an at least substantially quadrilateral cross section.

3. The agitator device as claimed in claim 1, wherein the beam element and the connection element have an at least substantially identical material thickness in a common connection region.

4. The agitator device as claimed in claim 1, wherein the beam element is realized so as to be twisted at least section-wise.

5. The agitator device as claimed in claim 1, further comprising at least one agitator blade which is connected to the beam element.

6. The agitator device as claimed in claim 5, wherein the agitator blade is connected to the beam element along a longitudinal side of said beam element.

7. The agitator device as claimed in claim 5, wherein a leading edge of the agitator blade terminates flush, at least section-wise, with at least one edge of the beam element.

8. The agitator device as claimed in claim 5, wherein the agitator blade and the beam element are connected to one another on a front side of the beam element.

9. The agitator device as claimed in claim 5, wherein the beam element and the agitator blade are connected to one another in a one-part implementation.

10. The agitator device as claimed in claim 1, wherein at least a portion of the carrier unit is implemented by a layered structure with at least two sheets.

11. The agitator device as claimed in claim 1, wherein the connection flange is configured for a detachable connection to a shaft flange.

12. The agitator device as claimed in claim 1, wherein the connection flange is configured for being screwed to a shaft flange.

13. The agitator device as claimed in claim 1, wherein the connection element has a cylindrical recess which the connection flange surrounds.

14. The agitator device as claimed in claim 13, wherein in an installed state, an axis of rotation of the agitator device runs through the recess.

15. The agitator device as claimed in claim 1, wherein the beam element has at least one first portion with a constant, at least substantially rectangular, cross section, which adjoins the connection element.

16. The agitator device as claimed in claim 15, wherein the beam element has at least one second portion with an at least substantially rectangular, tapering cross section, wherein the first portion and the second portion join one another.

17. The agitator device as claimed in claim 16, wherein the first portion is at least two times longer than the second portion.

18. The agitator device as claimed in claim 1, wherein the beam element is of elongate form.

19. A method for producing an agitator device, as claimed in claim 1, having at least one carrier unit, which has at least one connection element for a connection to a drive shaft and at least one beam element for the fastening of at least one agitator blade, wherein the connection element and the beam element are produced from a common plate-like workpiece, wherein the connection element is formed as at least one connection flange, which is configured for a connection to a shaft flange, wherein the beam element has, in at least one direction, a tapering cross section, wherein the cross section of the beam element is tapered in a radially running direction away from the connection element.

* * * * *